United States Patent [19]

Dunn

[11] Patent Number: 4,913,616

[45] Date of Patent: Apr. 3, 1990

[54] HYDRAULIC IMPLEMENT REGENERATION SYSTEM

[75] Inventor: Donnell L. Dunn, Wausau, Wis.

[73] Assignee: J. I. Case Company, Racine, Wis.

[21] Appl. No.: 313,917

[22] Filed: Feb. 23, 1989

[51] Int. Cl.[4] ..... E02F 3/43

[52] U.S. Cl. ..... 414/697; 91/436

[58] Field of Search ..... 414/697, 699, 702; 91/436, 461, 520

[56] References Cited

U.S. PATENT DOCUMENTS

| | | | |
|---|---|---|---|
| 4,165,613 | 8/1979 | Bernhoft et al. | 91/461 X |
| 4,779,418 | 10/1988 | Artzberger | 91/520 X |
| 4,836,088 | 6/1989 | Seabaugh | 91/436 |

*Primary Examiner*—Frank E. Werner
*Assistant Examiner*—Donald W. Underwood
*Attorney, Agent, or Firm*—Dykema Gossett

[57] ABSTRACT

A hydraulic system for use in moving a bucket on an earth-working machine that includes a hydraulic cylinder and power piston with the piston being operably connected to the bucket. A change-over valve connects a source of pressure fluid and the reservoir to the opposite axial sides of the piston to move the piston in a selected direction and pivot the bucket either clockwise or counterclockwise. When the bucket is being moved in its clockwise position to dump the bucket, gravity assists its movement, and the bucket begins to actually move the power piston. When this happens, the piston may move so quickly that the hydraulic pump cannot supply adequate hydraulic fluid to the chamber in the cylinder. To supplement the hydraulic pump and ensure that the hydraulic chamber has sufficient fluid in it, a regeneration valve is disposed in a line returning fluid to the reservoir. When the change-over valve is in a position that will cause the bucket to be dumped, the regeneration valve is biased to a position that will restrict flow back to the reservoir and will cause a portion of the fluid being returned to the reservoir to be bypassed back into the line leading to the cylinder chamber that is powering the movement of the piston and bucket. By doing this, the regeneration valve supplements the hydraulic pump and will ensure that there is always sufficient fluid within the cylinder chamber.

5 Claims, 2 Drawing Sheets

HYDRAULIC IMPLEMENT REGENERATION SYSTEM

BACKGROUND OF THE INVENTION

The present invention relates in general to a regeneration system for use with a hydraulic power circuit that will dump and roll back the bucket of an earth-working machine. In particular, the regeneration system supplements the hydraulic system's pump when the bucket is being dumped and is pulled downwardly by gravity.

Modern earth-working machines typically have implements, such as buckets, that are powered by hydraulic systems. These systems may raise or lower the vertical position of an implement, actuate an implement, or move an implement about a pivot point. In a hydraulic system for powering the bucket of an earth-working machine, the system may raise or lower the vertical position of the bucket and dump and roll back the bucket. These systems have a piston connected to the bucket and disposed in an hydraulic cylinder with power chambers on both sides of the piston for powering the piston rearwardly and forwardly. In order to maintain adequate control over the speed of movement of the piston, it is important that these power chambers are adequately filled with hydraulic fluid. Problems can arise with an action such as dumping the bucket of an earth-working machine. These buckets are typically of large mass, and when they are moved to dump, the force of gravity will aid in the bucket moving downwardly. Since the bucket is moving under more than the force of the hydraulic fluid powering the piston, the piston will begin to move with the bucket faster than the hydraulic fluid could independently power it. When this happens, the hydraulic pump may not be able to supply sufficient hydraulic fluid to the power chamber to keep it adequately filled. This could result in a partially filled hydraulic chamber that will not provide adequate control to the operator.

It is thus an object of the present invention to provide a hydraulic system for powering the bucket of an earth-working machine that supplements the hydraulic pump when the bucket is being moved to dump and is moving downwardly due to gravity.

It is further an object of the present invention to utilize a hydraulic regeneration system for forcing cylinder return fluid to join fluid from the hydraulic pump for insuring an adequate supply to the cylinder when the implement is moved by gravity or another external force.

Moreover, it is an object to achieve these goals with a hydraulic system that is relatively simple.

These and other objects are addressed by the present invention.

SUMMARY OF THE INVENTION

In accordance with the present invention, a hydraulic circuit for an earth-working machine's bucket is disclosed which powers the bucket during dump and roll-back movements. The hydraulic circuit includes a change-over valve that can be positioned at a neutral position, a dump position, and a roll-back position which will return the bucket back after it has been dumped. The change-over valve's position is controlled by a control valve assembly that responds to operator signals to send high and low pilot pressure to the change-over valve in order to control its position. The change-over valve allows power fluid to be sent to other systems for use with the bucket, including for instance a lift cylinder arrangement. When the change-over valve is in its neutral position, the pressure fluid will reach the other systems; however, if the change-over valve is in either its dump or roll-back position, the flow of power fluid to the additional systems is blocked.

When the change-over valve is in its dump position, the pressure fluid is sent to one side of a hydraulic cylinder that moves the bucket, and the opposite side of the hydraulic cylinder is connected to a line that leads to the reservoir. If the change-over valve is in its roll-back position, the connection of these two lines is reversed. The regeneration system of the present invention includes a slide valve that can restrict the flow of the fluid back to the reservoir from the power cylinder. The slide valve is biased toward a restricted position by pressure in a line that monitors the pressure within the pilot lines for the change-over valve. If the pilot line pressure to the change-over valve is such that the change-over valve will move to its dump position, the regeneration system slide valve is biased towards its restricted position. As the slide valve of the regeneration system is restricted, the pressure in the line to the reservoir upstream of the regeneration system slide valve is increased. This results in the opening of a relief valve that connects the line to the reservoir to the line leading to the power chamber for the dumping of the bucket. As this relief valve opens, return flow from the line to the reservoir will be sent to the power chamber of the piston to supplement the hydraulic pump. As the bucket begins to move, aided by gravity, this supplement of the pump will ensure an adequate supply of fluid in the power chamber and allow the operator to maintain control over the movement of the bucket.

When the change-over valve is in its neutral or its roll-back position, the regeneration system remains at its non-restricted position. This is accomplished by a spring normally biasing the slide valve to its non-restricted position. When the change-over valve is in its neutral or roll-back position, the pilot pressure at the regeneration system valve will be low such that it cannot overcome the bias of the spring in the slide valve. Due to this, the slide valve is retained at its unrestricted position.

Therefore, the present invention provides a regeneration system for a hydraulic circuit that positions the bucket of an earth-working machine. This regeneration system supplements the hydraulic pump when the bucket is moved to its dump position and is assisted by gravity. Further, the present invention provides a regeneration system that is relatively simple.

Other advantages and features of the present invention will be more fully understood from the detailed description of the invention, the appended claims, and the drawings, which are briefly described hereinbelow.

DETAILED DESCRIPTION OF THE INVENTION

Figure 1:
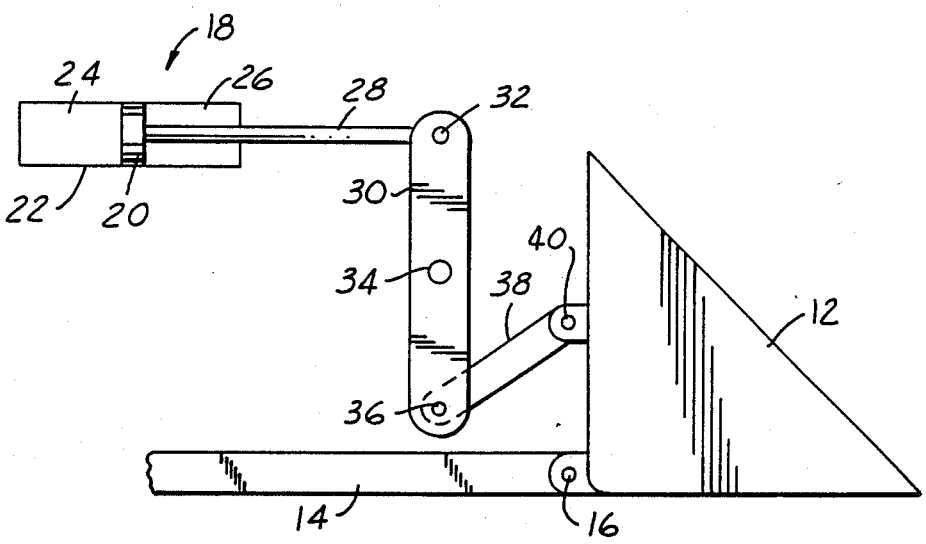
FIG. 1 is a largely schematic view of the mounting of a hydraulic piston that controls the position of an earth-working machine's bucket.

The basic mounting of the hydraulic power system of the present invention can be seen from FIG. 1. FIG. 1 shows a bucket 12 for use, for instance, with an earth-working machine, that comprises a first arm 14 that is connected to the vehicle and is pivoted at 16 to the bucket. A hydraulic cylinder system 18 will pivot bucket 12 about point 16 in order to dump and roll back the bucket. The hydraulic cylinder system 18 consists of a piston 20 and a cylinder 22 that has two power chambers 24 and 26, one on each side of piston 20. A piston rod 28 leads from piston 20 and is pinned to a link 30 at 32. Link 30 is pivotally attached at 34 to the vehicle and is pinned at 36 to a second link 38, which is in turn pinned at 40 to bucket 12. As can be understood from FIG. 1, when piston 20 is moved forwardly, or to the right as shown in FIG. 1, link 30 will move clockwise about its pivot point 34. This in turn will pull link 38 rearwardly, or to the left as shown in FIG. 1, and pivot bucket 12 counterclockwise about point 16, thus rolling back the bucket.

Alternatively, if piston 20 is moved rearwardly in cylinder 22, or to the left as shown in FIG. 1, link 32 is moved counterclockwise about point 34, and link 38 is moved forwardly, or to the right, as shown in FIG. 1, thus pivoting bucket 12 clockwise about pin 16 and dumping the bucket.

As can be appreciated, when the bucket is dumped, gravity will act on the heavy mass of the bucket and will move it downwardly faster than if the bucket were powered solely by the hydraulic cylinder system 18. When this happens, piston 20 begins to be powered by the downward movement of the bucket rather than the hydraulic fluid in power chamber 26. The piston's velocity will begin to exceed that which would be expected from the amount of fluid in chamber 26. It thus becomes necessary to increase the amount of hydraulic fluid in chamber 26. However, the capacity of the hydraulic pump may not be adequate to supply sufficient fluid to maintain chamber 26 adequately filled. If chamber 26 is not sufficiently filled, there will be air in this hydraulic cylinder, and the bucket controls will not be able to function as quickly as desired.

Figure 2:
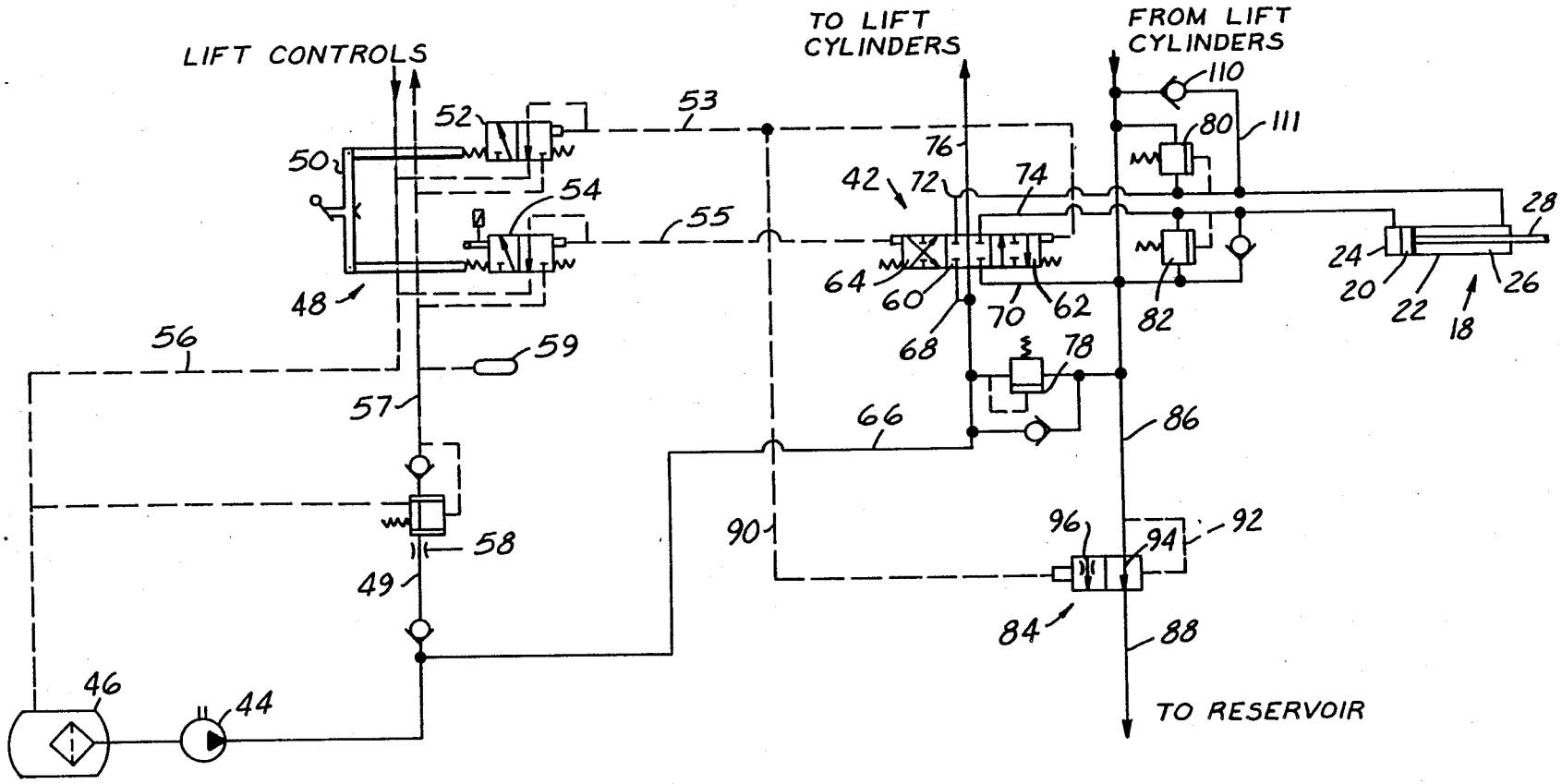
FIG. 2 is a schematic view of the hydraulic circuitry that powers the piston of FIG. 1.

To ensure that chamber 26 is always sufficiently filled, the present invention includes a regeneration system that will supplement the hydraulic pump. This regeneration system and the overall hydraulic circuit for hydraulic cylinder system 18 can be best understood from FIGS. 2 and 3. As shown in FIG. 2, the hydraulic circuit includes piston 20, cylinder 22 with the two chambers 24 and 26, and piston rod 28. As also shown in FIG. 2, a change-over valve 42 is utilized to control the flow of fluid to hydraulic cylinder system 18. The change-over valve 42 controls the application of pressure fluid from hydraulic pump 44 or reservoir pressure from reservoir 46 to chambers 24 or 26. The change-over valve 42 is controlled by a control assembly 48 that includes a switch 50 that may be manually actuated by an operator to start the dump or roll-back movements of the bucket 12. The control assembly 48 includes a valve 52 that controls the pressure in a line 53 that leads to one side of change-over valve 42 and a second valve 54 that controls the pressure in a line 55 that leads to the opposite side of change-over valve 42. The control valve receives pressure fluid from a tap 49 off the main hydraulic power fluid line from pump 44.

The switch 50 actuates control valves 52 and 54 to select either reservoir pressure 56 or a high-pressure line 57. Pressure line 57 includes an orifice assembly 58 that reduces the high pressure from tap 49 and ensure that the high pressure in line 57 is greatly reduced from the normal system high pressure that is seen by tap 49. However, it is to be understood that the pressure in line 57 is still quite high, on the order of 550 psi, for instance. In addition, an accumulator 59 is disposed to ensure that there is always adequate supply of the control high pressure in line 57.

By actuating switch 50 to control the position of valves 52, 54, an operator can shift change-over valve 42 to any one of three positions. A first position 60 is a neutral position and maintains the bucket in its normal position, as shown in FIG. 1. A second position 62 acts as a dump position, and a third position 64 is a roll-back position. The position of change-over valve 42 controls the application of a high-pressure line 66, a high-pressure branch line 68, and a line 70 that is returned to the reservoir 46. The change-over valve 42 connects these three lines 66, 68, 70 to line 72 which leads to power chamber 26; line 74, which leads to power chamber 24; and a line 76 that leads to additional hydraulic systems, for instance lift cylinders, that change the vertical position of bucket 12.

As illustrated in FIG. 2, change-over valve 42 is in its first neutral position. In this position, lines 72, 74 that lead to power chambers 24, 26 are short-circuited in valve 42. Chamber lines 72, 74 are blocked off, and chambers 24, 26 are maintained at their current pressure and volume, thus retaining piston 20 at a static position. As can be understood from FIG. 1, if piston 20 is retained in a static position, bucket 12 will remain in its static position also. The change-over valve 42 is maintained in this neutral position since both valves 52 and 54 are connecting reservoir pressure from line 56 to their control lines 53, 55. As is seen from FIG. 2, lines 53 and 55 are applied to opposite sides of valve 42, and if lines 53, 55 are maintained at equal pressure, the valve will remain in its neutral position.

If, however, switch 50 is actuated to dump bucket 12, valve 52 will move forwardly or to the right, as shown in FIG. 2, and connect pressure line 57 through its control line 53. When this happens, the pressure on line 53 overcomes the pressure from line 55, and valve 42 will move to the left, as seen in FIG. 2, thus placing change-over valve 42 in its dump position 62. In its dump position, change-over valve 42 connects pressure line 68 to line 72 and connects return line 70 to line 74. Thus, in this dump position of change-over valve 42, pressure fluid is sent through line 72 to power chamber 26, and power chamber 24 is connected through line 74 back to reservoir 46. With the valve in this position, the pressure fluid entering chamber 26 will force the piston 20 to the left, as seen in FIG. 2, and move bucket 12 clockwise to dump it of its contents.

As can be seen, when change-over valve 42 is in its dump position, pressure line 66 is short-circuited and does not connect through to line 76. Thus, when the bucket is dumped, there is no pressure fluid sent to the lift cylinders.

When bucket 12 has been dumped to empty it of its contents, the operator will again actuate switch 50 to roll back the bucket and return it to its neutral position. This actuation will return valve 52 to the position shown in FIG. 2, and move the valve 54 to the right, as shown in FIG. 2, thus connecting line 57 to its control pressure line 55. Since line 53 is connected to reservoir pressure, and since line 55 is connected to high pressure, the change-over valve 42 will move to the right, as shown in FIG. 2. When change-over valve 42 is in this position, pressure tap 68 will connect high-pressure fluid to line 74 and power chamber 24, and reservoir return line 70 will be connected to line 72 and power chamber 26. In this roll-back position, power line 66 is also short-circuited from power line 76. With the valve in this position, the pressure fluid entering chamber 24 will force the piston 20 to the right, as shown in FIG. 2, and return bucket 12 counterclockwise to its original position.

Over-pressure relief valves 78, 80 and 82 are disposed in lines 66, 72, and 74, respectively, in order to ensure that the high pressure within these lines does not exceed a predetermined maximum level.

Figure 3:
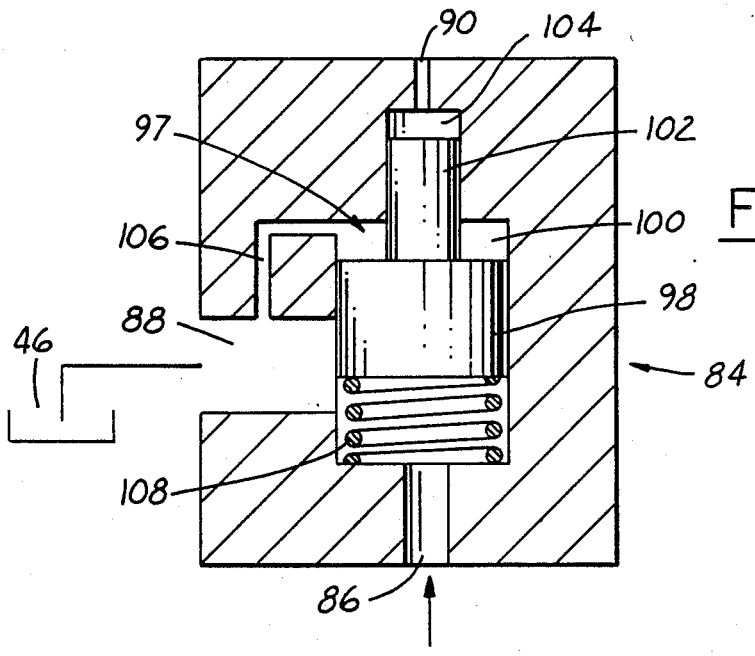
FIG. 3 is a view of an embodiment of a slide valve for use with the regeneration system of the present invention.

The regeneration system of the present invention will now be disclosed with reference to FIGS. 2 and 3. The regeneration system consists, in part, of valve 84 that is disposed in the line leading to the reservoir 46 between portions 86 and 88. Pressure tap 90 leads to valve 84 from control line 53. Line 90 is at the control pressure within line 53 and will thus give a pilot signal to valve 84 when change-over valve 42 has been moved to its dump position. That is, when change-over valve 42 is being moved to its dump position, a high pressure will exist in line 53 and will communicated through line 90 to valve 84. As shown schematically in FIG. 2, second tap 92 extends to the side of valve 84 opposite to tap 90 and is at the pressure within line 86. Valve 84 contains a free flow-through line 94 and a restricted flow-through line 96. As can be understood from FIG. 2, if the pressure within line 90 is higher than the pressure within line 92, valve 84 will move to the right, as shown in FIG. 2, thus connecting line 86 to line 88 through restricted flow-through line 96. If, however, a low pressure exists within line 90, the valve will be maintained at its unrestricted flow-through position connecting line 86 to line 88 through the unrestricted flow line 94. It can thus be understood that when there is a high pressure existing within line 53, that is, when the bucket is being dumped, line 90 will also contain a high pressure, and valve 84 will be at its restricted flow-through position 96.

The structure of valve 84 can be best understood with reference to FIG. 3. As can be seen in FIG. 3, valve 84 consists of a slide valve 97 with a first enlarged portion 98 that rides in first cylinder 100 and a second smaller portion 102 that is guided in second cylinder 104. Return line 86 is communicated to a first face of enlarged portion 98, and line 88, that leads to reservoir 46, is communicated through line 106 to the chamber 100 on the opposed face of enlarged portion 98. Line 90 is communicated to chamber 104, and spring 108 normally biases the entire slide valve to unrestricted position 94, shown schematically in FIG. 2. If the pressure within line 90 is low, spring 108 will maintain valve 84 in this unrestricted position 94. However, if the pressure in line 90 is high, that is, if valve 52 has been actuated to dump bucket 12, this pressure will overcome spring 108 and move slide valve 97 downwardly. As can be seen, if slide valve 97 is moved downwardly, it will restrict the flow from line 86 to line 88.

If control 48 has not been actuated to dump bucket 12, that is, if there is a roll-back or a neutral position desired, the pressure in line 90 will be low. As long as the pressure in line 90 is low, spring 108 will overcome the force of pressure 90, and slide valve 97 will be retained at its unrestricted position. It is to be understood that chamber 100 and line 86 are normally at the nominal reservoir pressure. If, in addition, line 90 is at its low or reservoir pressure, chamber 104 will also be at its reservoir pressure. When chamber 104 and chamber 100 are both at the reservoir pressure, they will be roughly equal to the pressure on the bottom face of slide valve 97, and thus all the fluid pressures acting on slide valve 97 will cancel out. For this reason, spring 108 need not be large or have a very strong spring force.

When slide valve 97 has been biased by the pressure in line 90 to its restricted position 96, the flow between lines 86 and 88 will be restricted. When this happens, the fluid will back up in line 86, and the pressure within line 86 will rise. A check valve 110 is mounted in line 111 that communicates line 86 to line 72. Valve 110 is set to open at a pressure slightly above the normal reservoir pressure of the system and will return fluid from line 86 back to line 72, thus supplementing the amount of fluid being sent to power chamber 26. When control assembly 48 has been actuated so as to dump the bucket 12, the slide valve 84 will be moved to restricted position 96, thus causing the pressure within line 86 to rise and open valve 110. When valve 110 is open, return fluid from line 86 will be sent through line 111 into line 72 to supplement pump 44. This regeneration system will act to ensure that there is always sufficient fluid within power chamber 26.

A working embodiment of the present invention has been disclosed; however, further modifications of the invention may be made without departing from the scope and content of the invention, which can be better understood when considered in light of the appended claims.

What is claimed is:

1. A hydraulic system for use in moving an implement, comprising:

a hydraulic cylinder;

a piston mounted in said hydraulic cylinder;

an implement operably connected to said piston to be moved by said piston;

said cylinder and said piston defining a first power chamber on one side of said piston, a second power chamber on the opposite side of said piston and chamber lines leading to each of said power chambers;

a source of pressure hydraulic fluid;

a reservoir for returning hydraulic fluid and a reservoir line leading to said reservoir;

a change-over valve operably connected to said chamber lines, said pressure fluid source and said reservoir to selectively connect said pressure fluid source to one of said chamber lines and to connect said reservoir, through said reservoir line, to the other of said chamber lines, the connection of the pressure hydraulic fluid to a first of said power chambers moving the piston in a direction that will pivot the implement in a direction such that said implement's movement is assisted by gravity and the connection of said pressure fluid to the second of said power chambers causing the piston to move in a direction that pivots said implement in a direction such that said implement's movement is opposed by gravity; and a regeneration valve being disposed in said reservoir line and being actuated when said change-over valve is in a position that causes said pressure hydraulic fluid to be sent to said first power chamber such that such regeneration valve causes a portion of the fluid returning to said reservoir from said second power chamber to be bypassed back into the chamber line leading to said first chamber to supplement the source of hydraulic fluid and compensate for the velocity said implement is moving at due to assistance of gravity;

said regeneration valve consists of a slide valve mounted within a valve cylinder;

a fluid line leading from said reservoir line entering said valve cylinder at one position and a second fluid line leading to said reservoir extending from said valve cylinder at a second position;

said slide valve being normally biased to a first position at which fluid can move from said reservoir line to said second fluid line leading to said reservoir and is unrestricted; and a pressure tap leading from the one of said control pressure line that will contain the pressure control fluid when said change-over valve is being moved to its second position, said pressure tap applying the pressure control fluid against the bias on said slide valve so as to move said slide valve to a second position, the second position of said slide valve restricting the flow of said fluid from said reservoir line to said second fluid line leading to the reservoir.

2. A hydraulic system as recited in claim 1, and further wherein said change-over valve can be at plural positions including:

a first position that blocks any connection to either the first or second chamber line;

a second position that connects pressure fluid to said first chamber line and the reservoir line to said second chamber line;

a third position that connects pressure fluid to said second line and the reservoir to said first line; and said change-over valve allowing pressure fluid to flow from said source of pressure fluid to additional hydraulic circuits that further position said implement when said change-over valve is in its first position and said change-over valve blocking communication to said further hydraulic circuits when said change-over valve is in either its second or third positions.

3. A hydraulic system as recited in claim 2, and further wherein the position of said change-over valve is controlled by a control assembly that comprises two control valves, a source of pressure control fluid and a source of reservoir pressure;

each of said control valves communicating either said pressure control fluid or said reservoir pressure through control pressure lines to respective axial ends of said change-over valve, each of said control valves being normally positioned to communicate reservoir pressure to respective axial ends of said change-over valve; and wherein either of said control valves can be actuated to communicate pressure fluid to the respective axial end of said change-over valve to bias said change-over valve to either its second or third positions.

4. A hydraulic system as recited in claim 3, and further wherein said pressure control fluid is at a lower pressure than said pressure hydraulic fluid.

5. A hydraulic system as recited in claim 1, and further comprising:

a relief valve mounted on a fluid line connecting said reservoir line to said chamber line leading to said first power chamber, said relief valve being operable to open at a preset pressure; and the restriction of flow between the reservoir line and the second fluid line by said slide valve being in its second position causing the pressure in said reservoir line to rise, said relief valve opening to communicate said return valve to the line leading to said power chamber when the pressure on said return line reaches said preset pressure.

* * * * *